US005198041A

United States Patent [19]

Takemoto et al.

[11] Patent Number: 5,198,041

[45] Date of Patent: Mar. 30, 1993

[54] SHAPE MEMORY STAINLESS STEEL EXCELLENT IN STRESS CORROSION CRACKING RESISTANCE AND METHOD THEREOF

[75] Inventors: Toshihiko Takemoto, Tokuyama; Masayuki Kinugasa, Hiroshima; Teruo Tanaka, Kure; Takashi Igawa, Yamaguchi, all of Japan

[73] Assignee: Nisshin Steel Co., Ltd., Tokyo, Japan

[21] Appl. No.: 835,433

[22] PCT Filed: Aug. 4, 1990

[86] PCT No.: PCT/JP90/01001

§ 371 Date: Feb. 25, 1992

§ 102(e) Date: Feb. 25, 1992

[87] PCT Pub. No.: WO91/02827

PCT Pub. Date: Mar. 7, 1991

[30] Foreign Application Priority Data

Aug. 25, 1989 [JP] Japan ..... 1-217498

[51] Int. Cl.[5] ..... C21D 8/00; C22C 38/38

[52] U.S. Cl. ..... 148/402; 148/563

[58] Field of Search ..... 148/402, 563

[56] References Cited

U.S. PATENT DOCUMENTS 4,933,027 6/1990 Moriya et al. ..... 148/402

5,032,195 7/1991 Shin et al. ..... 148/402

FOREIGN PATENT DOCUMENTS 62-170457 7/1987 Japan .

63-216946 9/1988 Japan .

*Primary Examiner*—Deborah Yee

*Attorney, Agent, or Firm*—Lowe, Price, LeBlanc & Becker

[57] ABSTRACT

A shape memory stainless steel containing more than 10% by weight of Cr excellent in resistance to stress corrosion cracking and having sufficient function as a shape memory alloy, which comprises, by weight, up to 0.10% of C, 3.0 to 6.0% of Si, 6.0 to 25.0% of Mn, up to 7.0% of Ni, more than 10.0% and not more than 17.0% of Cr, 0.02 to 0.3% of N, 2.0 to 10.0% of Co and more than 0.2% and not more than 3.5% of Cu, and at least one selected from up to 2.0% of Mo, 0.05 to 0.8% of Nb, 0.05 to 0.8% of V, 0.05 to 0.8% of Zr, 0.05 or 0.8% of Ti, the balance being Fe and unavoidable impurities, the alloying components being adjusted so that a D value is not less than −26.0, wherein the D value is defined by the following equation:

$$D = Ni + 0.30 \times Mn + 56.8 \times C + 19.0 \times N + 0.73 \times Co + Cu - 1.85 \times [Cr + 1.6 \times Si + Mo + 1.5 \times (Nb + V + Zr + Ti)].$$

4 Claims, 1 Drawing Sheet

SHAPE MEMORY STAINLESS STEEL EXCELLENT IN STRESS CORROSION CRACKING RESISTANCE AND METHOD THEREOF

FIELD OF THE INVENTION

The invention relates to a shape memory stainless steel excellent in shape memory effect and a method for enhancing shape memory effect thereof. More particularly, the invention relates to a shape memory stainless steel excellent in resistance to stress corrosion cracking which can advantageously develop its shape memory effect when used as fixing or fastening parts of machines, or as a pipe joint.

BACKGROUND OF THE INVENTION

As alloys exhibiting shape memory effect, there are known nonferrous-metal alloys including Ni—Ti alloys and Cu alloys as well as ferrous metal alloys such as Fe—Pd alloys, Fe—Ni alloys and Fe—Mn alloys. Among others, Fe—Mn alloys are inexpensive, and thus, because of their commercial value, various alloys of this Fe—Mn series are reported in patent literatures, for example, Fe—(15.9-30.0%) Mn alloys in JP A 55-73846, Fe—Mn—(Si, Ni, Cr) alloys in JP A 55-76043, Fe—(20-40%)Mn—(3.5-8%)Si alloys in JP A 61-76647 and Fe—(15-30%)Mn—N alloys in JP A 63-216946. furthermore, JP A 62-112720 discloses a method for enhancing shape memory effect of a Fe—Mn—Si alloy wherein a so-called training effect by repeating a cycle of working at a rate of up to 20% and heating to a temperature of at least 400° C. is utilized.

However, ferrous metal shape memory alloys are generally disadvantageous in low corrosion resistance. JP A 61-201761 discloses examples of Fe—Mn—Si alloys whose corrosion resistance is improved by adding Cr. However, the Cr content taught is too low, i.e. not more than 10.0%, to achieve corrosion resistance well comparable with that of stainless steels. Furthermore, JP A 63-216946 teaches to improve corrosion resistance of ferrous metal shape memory alloys by adding Cr. Again, however, the Cr content disclosed is 10% or less and it is not taught how to realize a desired level of shape memory characteristics with the ferrous metal shape memory alloys having Cr, which is a ferrite former, in excess of 10% incorporated therein.

On the other hand, as to general stainless steels, "Scripta Metallurgica, 1977, vol. 5, pp.663~667" reports that SUS304 steel exhibits shape memory effect, if it is deformed at −196° C. and then heated to room temperature, however, its shape recovery is too small to put it to practical use.

OBJECT OF THE INVENTION

An object of the invention is to provide a shape memory alloy containing more than 10% of Cr, which alloy is capable of exhibiting such a shape memory effect that even though the temperature of secondary deformation is not very low, for example, even though the temperature of secondary deformation is slightly below room temperature, when it is heated to moderately elevated temperature after the secondary deformation, it can recover its primary shape prior to the secondary deformation, and which alloy does not substantially suffer from stress corrosion cracking that may be a problem when the alloy is used as a pipe joint or the like.

DISCLOSURE OF THE INVENTION

According to the invention, there is provided a shape memory stainless steel excellent in resistance to stress corrosion cracking, which comprises, by weight, up to 0.10% of C, 3.0 to 6.0% of Si, 6.0 to 25.0% of Mn, up to 7.0% of Ni, more than 10.0% and not more than 17.0% of Cr, 0.02 to 0.3% of N, 2.0 to 10.0% of Co and more than 0.2% and not more than 3.5% of Cu, and optionally at least one selected from up to 2.0% of Mo, 0.05 to 0.8% of Nb, 0.05 to 0.8% of V, 0.05 to 0.8% of Zr, 0.05 to 0.8% of Ti, the balance being Fe and unavoidable impurities, the alloying components being adjusted so that a D value is not less than −26.0, wherein the D value is defined by the following equation:

$$D=Ni+0.30\times Mn+56.8\times C+19.0\times N+0.73\times Co+Cu-1.85\times[Cr+1.6\times Si+Mo+1.5\times(Nb+V+Zr+Ti)]$$

When the steel having the above defined chemical composition is processed to an article of a predetermined shape, annealed to memorize the shape, deformed at a temperature of not higher than room temperature, heated to a temperature of at least 100° C. and allowed to cool to room temperature, the memorized shape can be recovered at a high percent of recovery. The processing temperature prior to the annealing may room temperature or higher. The article may be in the form of plates, pipes or any other arbitrary shapes. While the article may be deformed at room temperature, for example, about at 20° C., the lower the deformation temperature the higher percent of shape recovery can be achieved. The deformation may be done, as with conventional shape memory alloys, by drawing, pulling, compression or bending, or by diameter expansion of tubular articles.

If the steel having the above defined chemical composition is processed to an article of a predetermined shape, annealed, subjected one or more times to a training cycle comprising deformation to at a temperature of not higher than room temperature (primary deformation) and heating to a temperature of from 450° C. and 700° C., allowed to cool to room temperature, thereby to achieve and memorize a primary shape, deformed to a desired secondary shape at a temperature of not higher than room temperature (secondary deformation), heated to a temperature of at least 100° C. and allowed to cool to room temperature, the primary shape can be recovered at a still higher percent of recovery.

The stainless steel according to the invention has excellent resistance to stress corrosion cracking in addition to general corrosion resistance inherent to stainless steels.

DETAILED DESCRIPTION OF THE INVENTION

Figure 1:
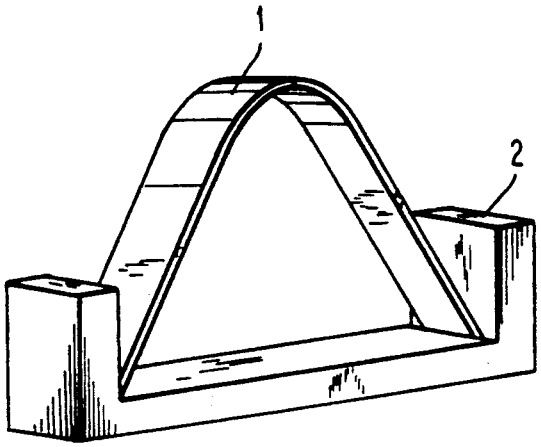
FIG. 1 is a perspective view of a test piece in the constrained condition which was subjected to the stress corrosion cracking test noted below. Under this condition the test piece is prevented from recovering its shape, that is it has a residual stress.

In order to achieve the objects, we have extensively studied influences of alloying components as well as mechanical working and heat treating conditions on shape memory effect of corrosion resistive Fe—Cr steels. As a result, we have found that if a Cr—Fe based metal having more than 10% of Cr is incorporated with appropriate amounts of Mn, Si and Co and the contents of C, N and Ni are properly controlled, the metal may exhibit a single austenitic phase in the annealed condition with no δ-ferritic and martensitic phases. We have also found that even if such a metal is deformed at a temperature not higher than room temperature, formation of permanent strain of work induced martensite (α') and dislocation can be suppressed, and in particular, when the metal is deformed at a temperature of 0° C. or lower, formation of work induced ε-phase can be facilitated and in consequence, after deformation, if the metal is heated to its As point (temperature at which ε-phase starts to transform to γ-phase) or higher, the metal exhibits excellent shape memory effect. We have further found that the shape memory effect will be remarkably enhanced by carrying out one or more times a training treatment comprising deformation at a temperature of not higher than room temperature and heating at a temperature of 450° C. or higher.

Such a shape memory stainless steel has a high general corrosion resistance well comparable with other stainless steels. However, in some applications, for example, when used as a pipe joint, since the steel which has shape-recovered under constraint has an internal strain (residual stress), resistance to stress corrosion cracking is of importance. General information about resistance to stress corrosion cracking of general stainless steels, such as SUS304, is not necessarily applicable to shape memory stainless steels of high Mn-high Si-high Co series. On such Fe—Cr shape memory stainless steels incorporated with appropriate amounts of Mn, Si and Co and having properly controlled C, N and Ni contents. As a result, we have found that while C, Mn and Ni adversely affect resistance to stress corrosion cracking, Co, N and Cu, in particular N and Cu, enhance resistance to stress corrosion cracking. We have further found that Cu is also effective to enhance shape memory effect.

Reasons for the restrictions of the alloying components of the stainless steel alloy used herein will now be described.

C is a strong austenite former and serves effectively formation of a δ-ferritic phase in the annealed condition. Further C is a useful element to improve shape memory effect. However, C adversely affects resistance to stress corrosion cracking. Moreover, if C is included so much, when a training cycle of deformation in the temperature range of not higher than room temperature and heating in the temperature range of at least 450° C. is carried out one or more times, Cr carbide is produced to disadvantageously deteriorate corrosion resistance and workability. For this reason the content of C must be up to 0.10%.

Since during the step of deformation Si acts to prevent generation of permanent strain and to facilitate formation of a work induced ε-phase, Si is indispensable to develop excellent shape memory effect in the steel according to the invention and, thus, at least 3.0% of Si must be included. However, Si is a strong ferrite former, and therefore, the presence of an excessive amount of Si, not only retains so much δ-ferritic phase in the annealed condition to deteriorate shape memory effect, but also adversely affects hot workability of the steel to make the steel making difficult. Accordingly, the upper limit for Si is now set as 6.0%.

Mn is an austenite former and serves to control formation of a δ-ferrite phase in the annealed condition. Further since during the step of deformation Mn acts to prevent generation of permanent strain and to facilitate formation of a work induced ε-phase, Mn is effective to enhance shape memory effect. For these purposes at least 6.0% of Mn is required. However, Mn adversely affects resistance to stress corrosion cracking, and if Mn is included so much, on the contrary, it restricts formation of a work induced ε-phase to decrease shape memory effect, and therefore, the upper limit for Mn is now set as 25.0%.

Ni is an austenite former and is useful to prevent formation of a δ-ferrite phase in the annealed condition. However, if Ni is included so much, permanent strain may occur in the step of deformation at low a temperature to decrease shape memory effect and lowers resistance to stress corrosion cracking. Accordingly, the upper limit for Ni is now set as 7.0%.

Cr is an indispensable element for stainless steels and more than 10% of Cr is required to achieve general high corrosion resistance. Further since Cr restricts generation of permanent strain during the step of deformation at a low temperature, Cr is effective to improve shape memory effect. However, since Cr is a ferrite former, if it is included so much, a δ-ferrite phase is likely to remain in the annealed condition, thereby adversely affecting shape memory effect. Accordingly, the upper limit for Cr is now set as 17.0%.

N enhances resistance to stress corrosion cracking. Furthermore, N is an austenite former and effectively acts to prevent a δ-ferrite phase from remaining in the annealed condition. Moreover, N controls generation of permanent strain during the step of deformation, thereby enhancing shape memory effect. For these effects, at least 0.02% of N is required. However, if N is included so much, blow holes are generated in an ingot prepared in the steel making process, and thus, a sound ingot cannot be obtained. Thus, the upper limit for N is now set as 0.30%.

Co is an austenite former and effectively acts to prevent a δ-ferritic phase from remaining in the annealed condition. Further Co also effectively serves to control the generation of permanent strain during the step of deformation and to facilitate formation of a work induced ε-phase, thereby enhancing shape memory effect. Moreover, Co enhances resistance to stress corrosion cracking. For these effects at least 2.0% of Co must be included. However, even if an increasing amount of Co is included, the effects are saturated, and so the upper limit for Co is now set as 10.0%.

Cu is an essential element for the steel according to the invention, since it remarkably increases resistance to stress corrosion cracking of the steel. Furthermore, Cu is an austenite former and effectively acts to prevent a δ-ferrite phase from remaining in the annealed condition thereby to enhance shape memory effect. For these effects more than 0.2% of Cu is required. However, addition of an unduly excessive amount of Cu adversely affects hot workability of the steel. Accordingly, the upper limit for Cu is now set as 3.5%.

Nb, V, Zr and Ti are useful elements to maintain corrosion resistance and workability of the steel, since they serve to prevent formation of Cr carbide in the repeated cycle of deformation at not higher than room temperature and heating at an elevated temperature of 450° C. or higher. Accordingly, at least one of these elements is preferably included in an amount of at least 0.05%. However, since these elements are all ferrite formers, a δ-ferrite phase may remain in the annealed condition, and if these elements are included so much, shape memory effect is adversely affected, and so the upper limit for the content of each element is now set as 0.8%.

Mo is effective to enhance corrosion resistance of the steel. However, since Mo is a ferrite former and if so much Mo is included, a δ-ferrite phase may remain in the annealed condition to decrease shape memory effect and so the upper limit for Mo is now set as 2.0%.

We have experimentally found that the D value calculated according to the aforementioned equation is a measure of an amount of a δ-ferrite phase which has remained in the annealed condition and which adversely affects shape memory effect. We have further found that if the D value is less than −26.0, so much δ-ferrite phase remains to deteriorate shape memory effect. Accordingly, the alloying components must be mutually adjusted in order to make the D value not less than −26.0 with their individual proportions within the aforementioned respective ranges.

The steel according to the invention excellent in resistance to stress corrosion cracking having the above-described chemical composition may develop its shape memory function, when treated in the manner as noted below.

First, the steel is mechanically worked at room or warm temperature to form an article of a predetermined shape, and the article is annealed to memorize the shape. The steel according to the invention is substantially austenitic with no δ-ferritic and martensitic phases in the annealed condition, that is in the condition as annealed and allowed to cool to room temperature. While by the mechanical working, ε-phase, displacement and permanent strain of α′ phase are formed in the resulting article, the ε-phase and the permanent strain completely disappear by annealing the article.

The annealed article is then deformed at a temperature not higher than room temperature. This deformation at low temperature promote the formation of a work induced ε-phase. The shape after the deformation is as such maintained at temperatures below the As of the steel. When the deformed article is heated to a temperature of the As point or higher, the original shape of the article before the deformation is recovered at a high percent of recovery and maintained even if allowed to cool to room temperature. The As point of the steels according to the invention is near room temperature. Accordingly, the heating temperature for recovering the deformed article to the original shape need not be very high, and may be at least 100° C., preferably at least 200° C. Since the transformation of ε-phase to δ-phase at the As point or higher is accelerated by temperature, the higher the temperature the shorter the heating time. The heating time may normally be as short as one minute.

In order to achieve still better shape memory and recovery effect, the following method is conveniently utilized. First, the steel according to the invention is mechanically worked at room or warm temperature to form an article of a predetermined prime shape, and the article is annealed. Thereafter, the article is deformed or mechanically worked at a temperature of not higher than room temperature (primary deformation), heated to a temperature of from 450° C. and 700° C.,and allowed to cool to room temperature. This primary deformation and heating may be repeated two or more times. By this treatment a desired primary shape is achieved and memorized. The article having the primary shape is deformed to a desired secondary shape at a temperature of not higher than room temperature (secondary deformation). When the article having the secondary shape is heated to a temperature of at least the As point of the steel, the primary shape is recovered and maintained even when allowed to cool to room temperature. The more the number of the above-mentioned training cycles comprising the primary deformation at a temperature of not higher than room temperature and heating at a temperature of from 450° C. to 700° C., the more satisfactorily high percent of shape recovery can be achieved even when an amount of the secondary deformation is large. For example, even in a case wherein an amount of the secondary deformation is as large as 8%, the primary shape can be recovered at a satisfactorily high percent of recovery. Incidentally, upon the primary deformation a work induced ε-phase is formed, and the lower the deformation temperature the more the amount of an ε-phase formed. In the case of a high amount of deformation, a permanent strain is also generated inevitably. Accordingly, the heating after the primary deformation must be carried out at a temperature high enough not only to complete the transformation of the ε-phase to a γ-phase but also to remove the permanent strain. For this reason the heating temperature after the primary deformation should be at least 450° C. However, an unduly high heating temperature is likely to form Cr carbide which adversely affects corrosion resistance. Accordingly, the upper limit for the heating temperature is set as 700° C.

After the article has been subjected to the cycle comprising the primary deformation at a temperature not higher than room temperature and the heating one or more times, the subsequent secondary deformation at a temperature of not higher than room temperature only promotes formation of an ε-phase with generation of substantially no permanent strain. Accordingly, if the secondarily deformed article heated to a temperature of at least the As point of the steel, the primary shape is recovered at a high percent of recovery even if an amount of the secondary deformation has been considerably high.

Thus, the invention further provides a method of shape memorizing and shape recovering of the stainless steel excellent in resistance to stress corrosion cracking according to the invention or a method of using the stainless steel according to the invention, which comprises the steps of processing the stainless steel to an article of a predetermined shape and annealing the article to memorize the shape, deforming the annealed article at a temperature of not higher than room temperature, and heating the deformed article to a temperature of at least 100° C. and allowing it to cool to room temperature, thereby to recover the memorized shape.

As a more advantageous method there is provided a method of shape memorizing and shape recovering of the stainless steel excellent in resistance to stress corrosion cracking according to the invention, which comprises the steps of: processing the stainless steel to an article of a predetermined shape and annealing the article, subjecting the article one or more times to a training cycle comprising deformation at a temperature of not higher than room temperature and heating to a temperature of from 450° C. and 700° C., and allowing the sotrained article to cool to room temperature, thereby to achieve and memorize a primary shape, deforming the primary shape memorized article to a desired secondary shape at a temperature of not higher than room temperature, heating it to a temperature of at least 100° C. and allowing it to cool to room temperature, thereby to recover the primary shape.

The invention will be further illustrated by the following examples.

EXAMPLES

Each steel melt having a chemical composition (% by weight) indicated in Table 1 was prepared using a high frequency melting furnace. Steels A1 to A16 are steels according to the invention, while Steels B1 to B4 are comparative steels. Steels B1 and B2 have Si and Mn outside the ranges prescribed herein, respectively. Steel B3 does not contain Cu. Steel B4 has a D value of less than −26.0, although a content of each alloying element is within the range prescribed herein.

The steel melt was cast into an ingot, forged, hot rolled to a thickness of 3 mm, annealed, cold rolled to a thickness of 2 mm and annealed. From the cold rolled and annealed sheet a test piece having a width of 10 mm, a length of 75 mm and a thickness of 2 mm was cut out. This test piece can be said as a shaped article in the annealed condition. The test piece was bent at a temperature of −73° C. by 120° with a bend radius of 8 mm, and set in a constraining apparatus shown in FIG. 1. Under this constrained condition the test piece was heated to at a temperature of 400° C. for 15 minutes and allowed to cool to room temperature. By this treatment the test piece tends to recover its original sheet-like shape under the constrained condition, whereby and a residual stress is formed in the test piece. The test piece under the constrained condition was dipped in a boiling 42% $MgCl_2$ aqueous solution, and a time until stress corrosion cracking occurred was determined. Results are shown in Table 2 wherein Mark o indicates that stress corrosion cracking did not occur within 5 hours whereas Mark x indicates that stress corrosion cracking occurred within 5 hours.

Shape memory and recovery properties were estimated by the following tests. The hot rolled sheet having a thickness of 3 mm prepared in the manner described above, was annealed, and repeatedly cold rolled and annealed to provide a cold rolled and annealed sheet having a thickness of 1 mm. From this sheet a test piece having a width of 20 mm, a length of 200 mm and a thickness of 1.0 mm was cut out. This test piece can be said as a shaped article in the annealed condition. In one test, the test piece was deformed at a temperature of 20° C., −73° C. or −196° C. by imparting a tensile strain of 4%. The deformed piece was heated at a temperature of 400° C. for 15 minutes and allowed to cool to room temperature. Percent of shape recovery (Ro) was determined.

In another test, the test piece was deformed at a temperature of 20° C. or −73° C. by imparting a tensile strain of 6% (primary deformation), and the deformed piece was heated at a temperature of 600° C. for 15 minutes and allowed to cool to room temperature. The test piece so treated was again deformed at a temperature of 20° C. or −73° C. by imparting a tensile strain of 6% (secondary deformation), and the deformed piece was heated at a temperature of 600° C. for 15 minutes and allowed to cool to room temperature. Percent of shape recovery ($R_T$) to the shape after the primary deformation was determined.

Percent of shape recovery (Ro) was determined in the following manner. An initial gage length ($l_0$=50 mm) was marked on the test piece before the deformation, and the marked gage length after the tensile strain was imparted at the low temperature was measured. By subtracting the initial gage length from the measured gage length, an amount of strain ($l_1$) was determined. The gage length after the test piece was heated and allowed to cool to room temperature was measured, and a length ($l_2$) was calculated by subtracting the latter measured gage length from ($l_0+l_1$). Percent of shape recovery was calculated from the following equation.

$$R=(l_2/l_1)\times 100(\%)$$

Percent of shape recovery ($R_T$) was determined in the following manner. An initial gage length ($l_0$=50 mm) was marked on the test piece after it was primarily deformed, heated and allowed to cool to room temperature (that is before the secondary deformation), and the marked gage length after the secondary deformation was measured. By subtracting the initial gage length from the measured gage length, an amount of strain ($l_1$) was determined. The gage length after the secondarily deformed test piece was heated and allowed to cool to room temperature was measured, and a length ($l_2$) was calculated by subtracting the latter measured gage length from ($l_0+l_1$). Percent of shape recovery was calculated from the equation described above.

The determined Ro and $R_T$ values are also shown in Table 2.

As seen from Table 2, while Comparative steels B1, B2 and B4 are excellent in resistance to stress corrosion cracking, they have low Ro and $R_T$ values at 20° C. which indicate unsatisfactory shape memory effect. They have slightly increased Ro and $R_T$ values at −73° C. and −196° C., which are still unsatisfactory. Comparative steel B3 containing no Cu is poor in resistance to stress corrosion cracking. In contrast, Steels A1 to A16 according to the invention are all excellent in resistance to stress corrosion cracking. They all exhibit excellent shape memory effect as reflected by their Ro and $R_T$ values at 20° C. as high as at least 42%, and in particular by their remarkably increased Ro and $R_T$ values in the case of deformation at lower temperature as high as at least 65%.

TABLE 1

| | Steel | C | Si | Mn | P | S | Ni | Cr | N | Co | Cu | Others | D value |
|---|---|---|---|---|---|---|---|---|---|---|---|---|---|
| A | A1 | 0.035 | 4.86 | 9.88 | 0.023 | 0.003 | 3.98 | 11.94 | 0.032 | 6.01 | 1.15 | — | −21.4 |
| | A2 | 0.038 | 5.27 | 10.81 | 0.024 | 0.005 | 3.02 | 12.12 | 0.043 | 5.88 | 2.49 | — | −22.0 |
| | A3 | 0.041 | 5.16 | 12.51 | 0.024 | 0.003 | 1.98 | 12.35 | 0.045 | 6.15 | 3.08 | — | −21.6 |
| | A4 | 0.036 | 4.72 | 14.92 | 0.025 | 0.003 | 1.92 | 12.18 | 0.039 | 6.02 | 2.11 | — | −20.8 |
| | A5 | 0.042 | 4.78 | 17.87 | 0.024 | 0.004 | 0.06 | 12.01 | 0.040 | 6.10 | 1.70 | — | −21.7 |
| | A6 | 0.041 | 4.75 | 17.49 | 0.024 | 0.004 | 0.08 | 12.23 | 0.045 | 7.05 | 0.53 | — | −22.5 |
| | A7 | 0.029 | 4.80 | 21.58 | 0.025 | 0.004 | 0.87 | 12.51 | 0.186 | 3.54 | 1.21 | — | −21.0 |
| | A8 | 0.078 | 3.75 | 15.22 | 0.025 | 0.004 | 1.21 | 15.17 | 0.041 | 8.99 | 1.52 | — | −20.1 |
| | A9 | 0.009 | 4.70 | 14.88 | 0.024 | 0.003 | 6.01 | 11.88 | 0.102 | 6.82 | 1.14 | — | −16.9 |

TABLE 1-continued

| | Steel | C | Si | Mn | P | S | Ni | Cr | N | Co | Cu | Others | D value |
|---|---|---|---|---|---|---|---|---|---|---|---|---|---|
| | A10 | 0.010 | 4.78 | 17.52 | 0.025 | 0.004 | 4.13 | 12.28 | 0.081 | 8.05 | 0.98 | | −18.5 |
| | A11 | 0.037 | 4.67 | 12.27 | 0.024 | 0.004 | 4.01 | 12.16 | 0.041 | 6.50 | 1.06 | Nb:0.27 | −20.7 |
| | A12 | 0.040 | 4.70 | 17.86 | 0.025 | 0.004 | 1.02 | 12.51 | 0.039 | 6.21 | 1.89 | V:0.32 | −22.1 |
| | A13 | 0.039 | 4.66 | 12.52 | 0.025 | 0.004 | 3.95 | 12.11 | 0.041 | 6.55 | 0.95 | Nb:0.24, Zr:0.19 | −21.0 |
| | A14 | 0.040 | 4.78 | 12.98 | 0.025 | 0.005 | 3.98 | 12.26 | 0.045 | 6.32 | 0.98 | V:0.25, Ti:0.11 | −21.2 |
| | A15 | 0.009 | 4.84 | 15.52 | 0.024 | 0.004 | 2.01 | 12.23 | 0.088 | 6.50 | 2.02 | Nb:0.31 | −22.4 |
| | A16 | 0.040 | 4.88 | 17.76 | 0.025 | 0.004 | 4.02 | 12.17 | 0.040 | 6.05 | 1.35 | Nb:0.27, Cu:1.24 | −21.9 |
| B | B1 | 0.040 | 1.53 | 18.07 | 0.024 | 0.005 | 2.02 | 13.90 | 0.045 | 7.02 | 1.60 | — | −13.0 |
| | B2 | 0.035 | 5.18 | 4.05 | 0.025 | 0.004 | 2.12 | 13.05 | 0.040 | 6.25 | 1.52 | — | −27.3 |
| | B3 | 0.042 | 5.13 | 14.93 | 0.025 | 0.004 | 3.92 | 12.18 | 0.039 | 6.02 | — | — | −21.8 |
| | B4 | 0.036 | 5.23 | 8.92 | 0.025 | 0.003 | 1.98 | 13.52 | 0.031 | 3.88 | 1.06 | — | −29.3 |

A: Steel according to the invention
B: Comparative steel

TABLE 2

| | Steel | Stress Corrosion Cracking Resistance*1 | $R_o$ value (%) | | | $R_T$ value (%) | |
|---|---|---|---|---|---|---|---|
| | | | 20° C. | −73° C. | −196° C. | 20° C. | −73° C. |
| A | A1 | ○ | 56 | 82 | 91 | 52 | 80 |
| | A2 | ○ | 52 | 79 | 86 | 50 | 78 |
| | A3 | ○ | 54 | 81 | 90 | 52 | 78 |
| | A4 | ○ | 50 | 77 | 85 | 48 | 77 |
| | A5 | ○ | 51 | 80 | 88 | 48 | 78 |
| | A6 | ○ | 51 | 78 | 87 | 50 | 78 |
| | A7 | ○ | 49 | 79 | 86 | 47 | 76 |
| | A8 | ○ | 45 | 72 | 82 | 42 | 65 |
| | A9 | ○ | 52 | 79 | 88 | 51 | 80 |
| | A10 | ○ | 50 | 80 | 89 | 48 | 79 |
| | A11 | ○ | 53 | 82 | 90 | 52 | 81 |
| | A12 | ○ | 54 | 83 | 89 | 50 | 80 |
| | A13 | ○ | 52 | 80 | 88 | 50 | 78 |
| | A14 | ○ | 50 | 79 | 86 | 49 | 77 |
| | A15 | ○ | 55 | 82 | 90 | 50 | 78 |
| | A16 | ○ | 53 | 82 | 91 | 51 | 79 |
| B | B1 | ○ | 10 | 16 | 17 | 9 | 13 |
| | B2 | ○ | 19 | 25 | 28 | 15 | 22 |
| | B3 | x | 51 | 79 | 87 | 48 | 78 |
| | B4 | ○ | 25 | 44 | 47 | 20 | 29 |

A: Steel according to the invention
B: Comparative steel
*1Stress Corrosion Cracking Resistance
○ (Time until break > 5 hrs.)
x (Time until break ≦ 5 hrs.)

As demonstrated herein, the stainless steel according to the invention develop excellent shape memory effect by subjecting to deformation at low temperature or to repetition of deformation at low temperature and heating at a temperature of from 450° C. to 700° C., in spite of the fact that it contain more than 10% of Cr to enhance corrosion resistance. Furthermore, it is excellent in resistance to stress corrosion cracking. Accordingly, the steel according to the invention are particularly useful as a material for fixing or fastening parts of machines, or a pipe joint in the fields where corrosion resistance and in particular resistance stress corrosion cracking is required.

What is claimed is:

1. A shape memory stainless steel excellent in resistance to stress corrosion cracking, which comprises, by weight, up to 0.10% of C, 3.0 to 6.0% of Si, 6.0 to 25.0% of Mn, up to 7.0% of Ni, more than 10.0% and not more than 17.0% of Cr, 0.02 to 0.3% of N, 2.0 to 10.0% of Co and more than 0.2% and not more than 3.5% of Cu, the balance being Fe and unavoidable impurities, the alloying components being adjusted so that a D value is not less than −26.0, wherein the D value is defined by the following equation:

$$D=Ni+0.30\times Mn+56.8\times C+19.0\times N+0.73\times Co+Cu-1.85\times(Cr+1.6\times Si).$$

2. A shape memory stainless steel excellent in resistance to stress corrosion cracking, which comprises, by weight, up to 0.10% of C, 3.0 to 6.0% of Si, 6.0 to 25.0% of Mn, up to 7.0% of Ni, more than 10.0% and not more than 17.0% of Cr, 0.02 to 0.3% of N, 2.0 to 10.0% of Co and more than 0.2% and not more than 3.5% of Cu, and at least one selected from up to 2.0% of Mo, 0.05 to 0.8% of Nb, 0.05 to 0.8% of V, 0.05 to 0.8% of Zr, 0.05 to 0.8% of Ti, the balance being Fe and unavoidable impurities, the alloying components being adjusted so that a D value is not less than −26.0, wherein the D value is defined by the following equation:

$$D=Ni+0.30\times Mn+56.8\times C+19.0\times N+0.73\times Co+Cu-1.85\times[Cr+1.6\times Si+Mo+1.5\times(Nb+V+Zr+Ti)].$$

3. A method of shape memorizing and shape recovering of a stainless steel excellent in resistance to stress corrosion cracking, which comprises the steps of:

processing a stainless steel to an article of a predetermined shape and annealing the article to memorize the shape, said steel comprising, by weight, up to 0.10% of C, 3.0 to 6.0% of Si, 6.0 to 25.0% of Mn, up to 7.0% of Ni, more than 10.0% and not more than 17.0% of Cr, 0.02 to 0.3% of N, 2.0 to 10.0% of Co and more than 0.2% and not more than 3.5% of Cu, and optionally at least one selected from up to 2.0% of Mo, 0.05 to 0.8% of Nb, 0.05 to 0.8% of V, 0.05 to 0.8% of Zr, 0.05 to 0.8% of Ti, the balance being Fe and unavoidable impurities, the alloying components being adjusted so that a D value is not less than −26.0, wherein the D value is defined by the following equation:

$$D=Ni+0.30\times Mn+56.8\times C+19.0\times N+0.73\times Co+Cu-1.85\times[Cr+1.6\times Si+Mo+1.5\times(Nb+V+Zr+Ti)],$$

deforming the annealed article at a temperature of not higher than room temperature, and heating the deformed article to a temperature of at least 100° C. and allowing it to cool to room temperature, thereby to recover the memorized shape.

4. A method of shape memorizing and shape recovering of a stainless steel excellent in resistance to stress corrosion cracking, which comprises the steps of:

processing a stainless steel to an article of a predetermined shape and annealing the article, said steel comprising, by weight, up to 0.10% of C, 3.0 to 6.0% of Si, 6.0 to 25.0% of Mn, up to 7.0% of Ni, more than 10.0% and not more than 17.0% of Cr, 0.02 to 0.3% of N, 2.0 to 10.0% of Co and more than 0.2% and not more than 3.5% of Cu, and optionally at least one selected from up to 2.0% of Mo, 0.05 to 0.8% of Nb, 0.05 to 0.8% of V, 0.05 to 0.8% of Zr, 0.05 to 0.8% of Ti, the balance being Fe and unavoidable impurities, the alloying components being adjusted so that a D value is not less than −26.0, wherein the D value is defined by the following equation:

$$D=Ni+0.30\times Mn+56.8\times C+19.0\times N+0.73\times Co+Cu-1.85\times[Cr+1.6\times Si+Mo+1.5\times(Nb+V+Zr+Ti)],$$

subjecting the article one or more times to a training cycle comprising deformation at a temperature of not higher than room temperature and heating to a temperature of from 450° C. and 700° C., and allowing the so-trained article to cool to room temperature, thereby to achieve and memorize a primary shape, deforming the primary shape memorized article to a desired secondary shape at a temperature of not higher than room temperature, heating it to a temperature of at least 100° C. and allowing it to cool to room temperature, thereby to recover the primary shape.

* * * * *